US010065822B2

(12) United States Patent
Kanno

(10) Patent No.: US 10,065,822 B2
(45) Date of Patent: Sep. 4, 2018

(54) MEDIUM WINDING DEVICE AND METHOD THEREOF

(71) Applicant: Oki Data Corporation, Tokyo (JP)

(72) Inventor: Shunichi Kanno, Tokyo (JP)

(73) Assignee: Oki Data Corporation, Tokyo (JP)

( * ) Notice: Subject to any disclaimer, the term of this patent is extended or adjusted under 35 U.S.C. 154(b) by 160 days.

(21) Appl. No.: 15/074,789

(22) Filed: Mar. 18, 2016

(65) Prior Publication Data

US 2016/0332836 A1 Nov. 17, 2016

(30) Foreign Application Priority Data

May 12, 2015 (JP) ..... 2015-097527

(51) Int. Cl.

| | |
|---|---|
| ***B65H 23/198*** | (2006.01) |
| ***B65H 23/00*** | (2006.01) |
| ***B65H 23/04*** | (2006.01) |
| ***B65H 23/195*** | (2006.01) |
| *G03G 15/00* | (2006.01) |

(52) U.S. Cl.

CPC ..... *B65H 23/005* (2013.01); *B65H 23/048* (2013.01); *B65H 23/198* (2013.01); *B65H 23/1955* (2013.01); *B65H 2301/4493* (2013.01); *B65H 2404/62* (2013.01); *B65H 2511/142* (2013.01); *B65H 2511/214* (2013.01); *B65H 2515/31* (2013.01); *B65H 2801/12* (2013.01); *G03G 15/6517* (2013.01)

(58) Field of Classification Search

CPC .. B65H 23/005; B65H 23/048; B65H 23/198; B65H 23/1955

See application file for complete search history.

(56) References Cited

U.S. PATENT DOCUMENTS

| | | | | | |
|---|---|---|---|---|---|
| 3,441,825 | A * | 4/1969 | Dinger | B65H 23/042 | 242/413.6 |
| 3,701,493 | A * | 10/1972 | Welsch | B65H 23/044 | 242/413.2 |
| 5,437,417 | A * | 8/1995 | Kammann | B65H 23/198 | 242/412.1 |
| 5,941,473 | A * | 8/1999 | Kawano | B65H 23/198 | 242/413.1 |

(Continued)

FOREIGN PATENT DOCUMENTS

JP S63-051261 A 3/1988

*Primary Examiner* — Sang K Kim

(74) *Attorney, Agent, or Firm* — Muncy, Geissler, Olds & Lowe, P.C.

(57) ABSTRACT

A medium winding device for winding a continuous medium ejected from an image forming device includes a winding member that is rotatably arranged around which the medium is wound, an actuator that rotates the winding member to wind the medium on the winding member in a rolled state, a tension generation member that applies a tension to the medium being carried to the winding member, a roll diameter obtaining unit that obtains a roll diameter of the medium in the rolled state, wherein the roll diameter changes depending on an amount of the medium wound on the winding member, and a tension adjustment unit that adjusts the tension of the medium applied by the tension generation member depending on the roll diameter obtained by the roll diameter obtaining unit.

9 Claims, 9 Drawing Sheets

(56) References Cited

U.S. PATENT DOCUMENTS

2008/0048060 A1* 2/2008 Kessler ..... B65C 9/1803
242/417.1
2009/0101745 A1* 4/2009 St. Germain ..... B65H 23/048
242/417.3

* cited by examiner

| Roll Diameter | Small → Large | | | |
|---|---|---|---|---|
| Lever Angle (α) | α1 | α2 | α3 | α4 |
| Lever Angle Detection Sensor (a) | ON | OFF | ON | OFF |
| Lever Angle Detection Sensor (b) | OFF | OFF | ON | ON |

*Fig. 7*

| Lever Angle | Area | Activation/Deactivation Of Winding Motor in Each Area | | | | |
|---|---|---|---|---|---|---|
| α1 | AR1 | | | | Actv. | Deactv. |
| α2 | AR2 | | | Actv. | Deactv. | |
| α3 | AR3 | | Actv. | Deactv. | | |
| α4 | AR4 | Actv. | Deactv. | | | |
| ⋮ | | | | | | ⋮ |

| Bar Detection Sensor | Sensor Output States Of Winding Motor in Each Area | | | | |
|---|---|---|---|---|---|
| Bar Detection Sensor S1 | ON | ON | ON | OFF | ON |
| Bar Detection Sensor S2 | ON | ON | OFF | OFF | ON |
| Bar Detection Sensor S3 | ON | OFF | OFF | ON | ON |
| Bar Detection Sensor S4 | OFF | OFF | ON | ON | ON |
| Bar Detection Sensor S5 | OFF | ON | ON | ON | ON |

MEDIUM WINDING DEVICE AND METHOD THEREOF

CROSS REFERENCE TO RELATED APPLICATIONS

This application claims priority under 35 USC 119 to Japanese Patent Application No. 2015-097527 filed on May 12, 2015, the entire contents which are incorporated herein by reference.

TECHNICAL FIELD

The present invention relates to a medium winding device and a method for winding a medium.

BACKGROUND

Conventionally, in a printer configured to perform printing on a sheet as a long medium, i.e., a continuous paper, the continuous paper fed from a feeding part arranged in a main body of the printer, i.e., a device main body, is sent to a printing part and ejected to an outside of the printer from an ejection opening after performing the printing in the printing part.

In this type of printer, a rolled sheet winding device as a medium winding device is arranged adjacent to the ejection opening. In this rolled sheet winding device, a continuous paper ejected to the outside of the printer is wound on a winding roller as a winding member in a winding part, and a rolled sheet as a rolled medium is formed (for example, see Patent Document 1).

RELATED ART

[Patent Document 1] Japanese Unexamined Patent Application Publication No. S63-51261

However, in the conventional rolled sheet winding device, in accordance with the increase of the diameter of the rolled sheet in the winding part (or the roll diameter increases as the part winds the paper more), the tension applied to the carried continuous paper changes. Therefore, the hardness (or tightness) of the rolled sheet, that is, the winding hardness, cannot be made even. As a result, the continuous paper cannot be wound stably.

The present invention aims to provide a medium winding device and a method for winding a medium capable of solving the problems of the conventional rolled sheet winding device, making the winding hardness of the rolled medium even, and stably winding the medium.

SUMMARY

A medium winding device, which is disclosed in the application, for winding a continuous medium ejected from an image forming device includes a winding member that is rotatably arranged around which the medium is wound, an actuator that rotates the winding member to wind the medium on the winding member in a rolled state, a tension generation member that applies a tension to the medium being carried to the winding member, a roll diameter obtaining unit that obtains a roll diameter of the medium in the rolled state, wherein the roll diameter changes depending on an amount of the medium wound on the winding member, and a tension adjustment unit that adjusts the tension of the medium applied by the tension generation member depending on the roll diameter obtained by the roll diameter obtaining unit.

A method, which is disclosed in the application, for winding a medium that includes a medium winding device including a winding member rotatably arranged, an actuator rotating the winding member to wind a medium ejected from an image forming device on the winding member in a rolled state, and a tension generation member applying a tension to the medium that is being carried to the winding member, the method includes obtaining a roll diameter of the medium in the rolled state around the winding member, wherein the roll diameter changes depending on an amount of the medium, and adjusting the tension of the medium generated by the tension generation member depending on the obtained roll diameter.

In this case, since a roll diameter obtaining unit obtains a roll diameter of the rolled medium, which changes depending on the state of the medium wound on the winding member, and the tension generated on the medium by the tension generation member is adjusted depending on the obtained roll diameter. Therefore, the winding hardness of the rolled medium can be kept even from the beginning to the end of winding. As a result, the medium can be wound stably.

BRIEF DESCRIPTION OF THE DRAWINGS

FIG. 7 is an explanatory view showing a relationship between lever angles and movable ranges of a tension bar, and activation/deactivation of a winding motor according to the first embodiment of the present invention at the upper table. In the drawing, "Actv" means an activation and "Deactv." means a deactivation. Further, the lower table shows a relationship between ON/OFF state of the winding motor and sensor output state.

DETAILED DESCRIPTION OF THE PREFERRED EMBODIMENT(S)

Hereinafter, some embodiments of the present invention will be described in detail with reference to the drawings. In these embodiments, a printer as an image forming device and a rolled sheet wiring device as a medium winding device will be described.

Figure 1:
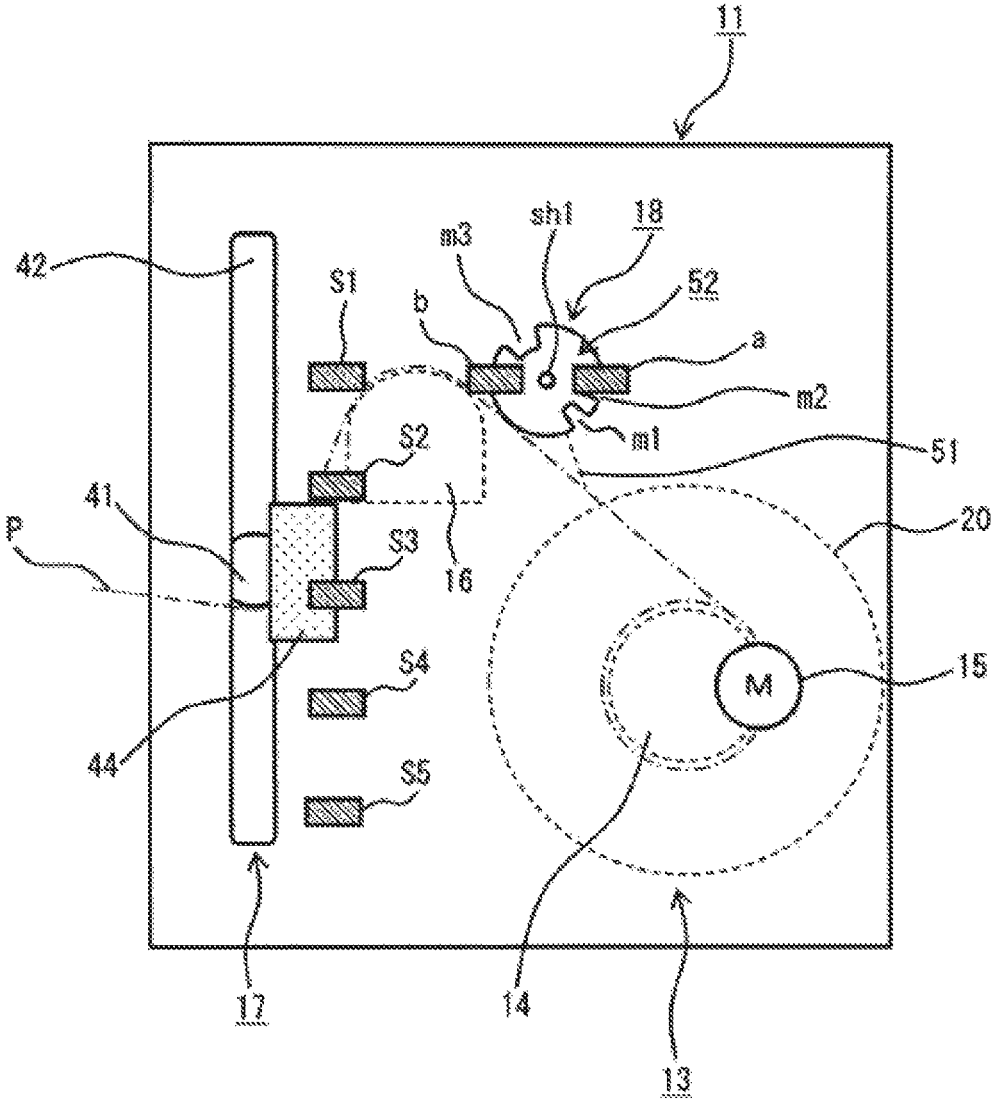
FIG. 1 is a schematic view showing a rolled sheet winding device according to a first embodiment of the present invention.
Figure 2:
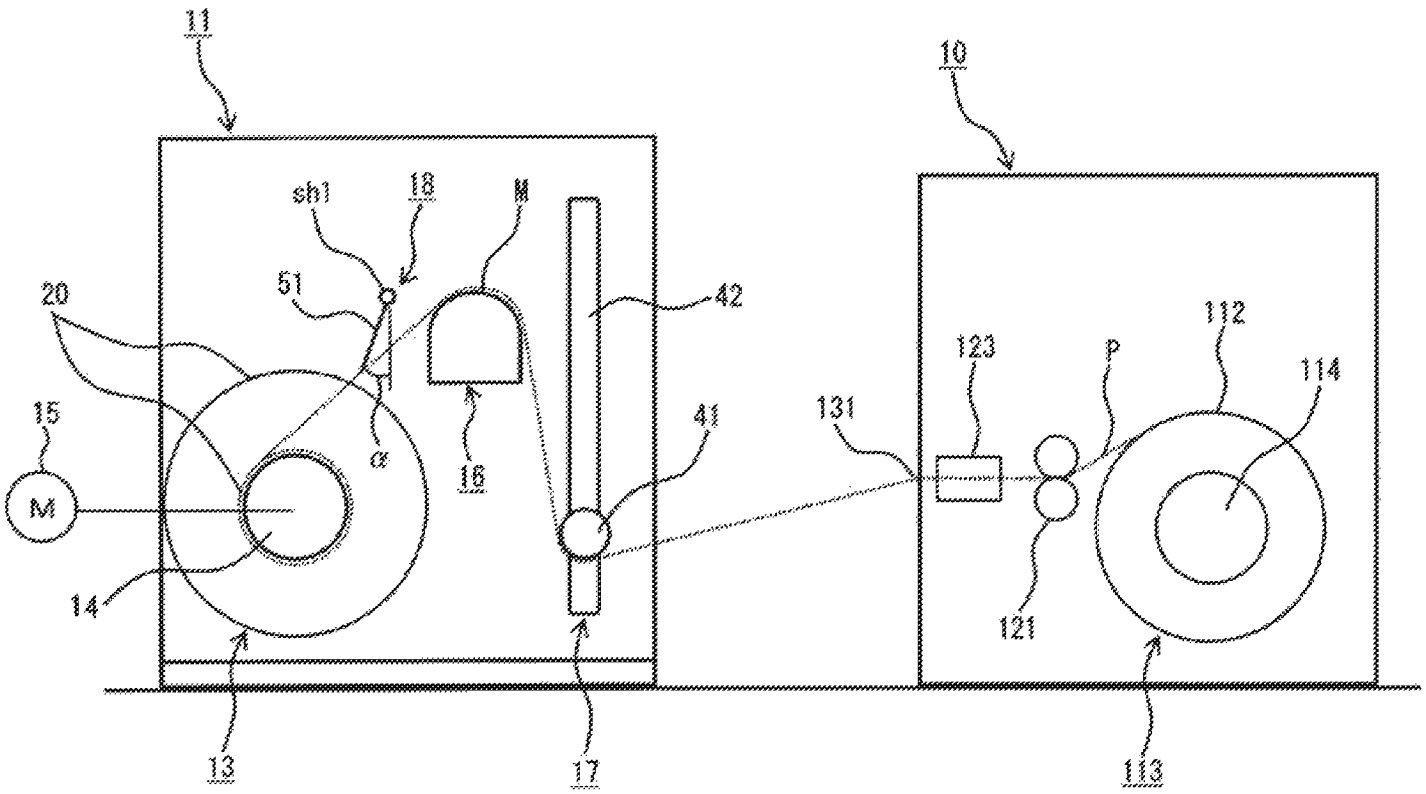
FIG. 2 is a schematic view showing a printer and the rolled sheet winding device according to the first embodiment of the present invention.

FIG. 1 is a schematic view showing a rolled sheet winding device according to the first embodiment of the present invention, and FIG. 2 is a schematic view showing a printer and the rolled sheet winding device according to the first embodiment of the present invention.

In these figures, the reference numeral "10" denotes the printer, and "11" denotes the rolled sheet winding device arranged adjacent to the printer 10.

The printer 10 includes, for example, a feeder 113 for setting a rolled sheet 112 as a rolled medium, a carrying roller pair 121 as a carrying mechanism for carrying a continuous paper P as a long medium fed from the feeder 113, and a print part 123 for forming and printing an image on the continuous paper P. The feeder 113 includes a feeding roller 114 for feeding the continuous paper P from the rolled sheet 112.

In this embodiment, the print part 123 is constituted by an electrographic system print mechanism, and includes: for example, an unillustrated photosensitive drum as an image carrier; an unillustrated charging roller as a charging device for equally charging the surface of the photosensitive drum; an unillustrated LED head as an exposure device for forming an electrostatic latent image as a latent image on the photosensitive drum in which the surface is charged; an unillustrated development roller as a developer carrier for forming a toner image as a developer image by developing the electrostatic latent image; an unillustrated transfer roller as a transfer member for transferring the toner image to the continuous paper P; and an unillustrated fuser as a fuser device for fusing the toner image to the continuous paper P.

The continuous paper P in which printing was performed is ejected from the ejection opening 131 of the printer 10 and sent to the rolled sheet winding device 11.

The rolled sheet winding device 11 includes: for example, a winding roller 14 as a winding member for winding the continuous paper P into a rolled state in accordance with the rotation, the winding roller being rotatably arranged in a winding part 13; a winding motor 15 as a winding actuator configured to rotate the winding roller 14; a friction member 16 arranged on an upstream side of the winding part 13 in the carrying direction of the continuous paper P so as to be in contact with the lower side face of the continuous paper P to guide the continuous paper P, which acts as a tension generation member for generating tension on the continuous paper P to be wound on the winding roller 14; a tension bar part 17 arranged on the upstream side of the friction member 16 in the carrying direction of the continuous paper P as a tension adjustment unit for adjusting the tension generated on the continuous paper P; and a roll diameter detection mechanism 18 for detecting the diameter, i.e., the roll diameter, of the rolled sheet 20 as a rolled medium formed when the continuous paper P is wound by the winding roller 14 in a rolled state.

In the friction member 16, the lower half part has a rectangular column shape and the upper half part has a semicylindrical shape, and the surface of the upper half part, that is, the sliding face M on which the continuous paper P slides, is formed of a material having a higher friction coefficient than a plastic material has. Such a high friction material is, for example, a rubber material made of a polyurethane-system material. When the continuous paper P slides on the sliding face M, frictional force is generated in the opposite direction of the carrying direction of the continuous paper P. With this, tension is applied to the continuous paper P carried between the winding part 13 and the friction member 16, and the winding hardness of the rolled sheet 20 is determined by the tension.

Further, the tension bar part 17 includes: for example, a tension bar 41 as a tension applying member arranged extending in the widthwise direction of the continuous paper P and movably in the height direction of the rolled sheet winding device 11; a guide 42 as a guiding member for guiding the tension bar 41 and arranged extending in the height direction of the rolled sheet winding device 11; bar detection sensors Si (i=1 to 5) as detection elements for detecting the position of the tension bar 41, the bar detection sensors being arranged at plural positions, five positions in this embodiment, in the height direction of the guide 42; and a shielding plate 44 for shielding the bar detection sensors Si, the shielding plate being fixed to one end of the tension bar 41 and configured to be moved in accordance with the movement of the tension bar 41 in the main body of the rolled sheet winding device 11, that is, in the device main body.

The tension bar 41 is constituted by an idler bar arranged so as to be in contact with the upper side face of the continuous paper P, and is configured to rotate in accordance with the carrying of the continuous paper P. The tension bar generates tension on the continuous paper P by self-weight to press the continuous paper P against the friction member 16. Therefore, the tension applied to the continuous paper P carried between the winding part 13 and the friction member 16 is increased by that amount.

The bar detection sensor Si turns off the sensor output when shielded by the shielding plate 44 and turns on the sensor output when not shielded by the shielding plate 44.

The sensor output, i.e., ON/OFF, of the bar detection sensor Si is sent to an unillustrated control unit. The control unit detects the position of the tension bar 41 based on ON/OFF of the bar detection sensor Si to activate or deactivate the winding motor 15 according to the position of the tension bar 41 and the roll diameter.

When the tension bar 41 reaches the lower limit position in the preset movable range along the guide 42, the winding motor 15 is activated, so that the winding speed vr of the continuous paper P when the winding roller 14 is rotated is set to be higher than the ejection speed vd when the continuous paper P is ejected from the printer. At this time, the tension bar 41 is moved (raised) upward along the guide 42 at a speed Vup which is proportionate to the speed difference δv between the winding speed vr and the ejection speed vd: $\delta v = vr - vd$.

On the other hand, when the tension bar 41 reaches the upper limit position in the movable range, the winding motor 15 is deactivated, so that the winding speed vr of the continuous paper P becomes 0 (zero), the ejection speed vd of the continuous paper P becomes the same value as the value when the winding motor 15 is activated, and the tension bar 41 is moved (lowered) downward along the guide 42 at a speed Vdown that is proportionate to the ejection speed vd.

Further, the roll diameter detection mechanism 18 includes: for example, a roll diameter detection lever 51 as a detection member and a detection lever that is swingably attached to the supporting shaft sh1 as the swinging center in a manner such that the tip end is in contact with the continuous paper P; a lever angle detection slit plate 52 as an interlocking member rotated interlocking with the swinging of the roll diameter detection lever 51; and lever angle detection sensors a and b as lever angle detection elements and interlocking member detection parts arranged at a plurality of positions, two positions in this embodiment, on the peripheral edge part of the lever angle detection slit plate 52 to detect the lever angle of the roll diameter detection lever 51 and generate a sensor output according to the lever angle.

The roll diameter detection lever 51 is arranged so that the tip end thereof is in contact with the upper side face of the continuous paper P by self-weight on the carrying path of the continuous paper P between the winding part 13 and the friction member 16.

The lever angle detection slit plate 52 is fixed to the supporting shaft sh1, and is provided with a plurality of slits, i.e., three slits m1 to m3 in this embodiment, at the peripheral edge part. In this embodiment, the slits m1 and m2 are formed adjacent to each other with a predetermined opening angle in the circumferential direction of the lever angle detection slit plate 52, and the slit m3 is formed at a position that is about 180 [degrees] apart from the slits m1 and m2 in the circumferential direction of the lever angle detection slit plate 52 with an opening angle that is larger than that of the slits m1 and m2.

Figure 3:
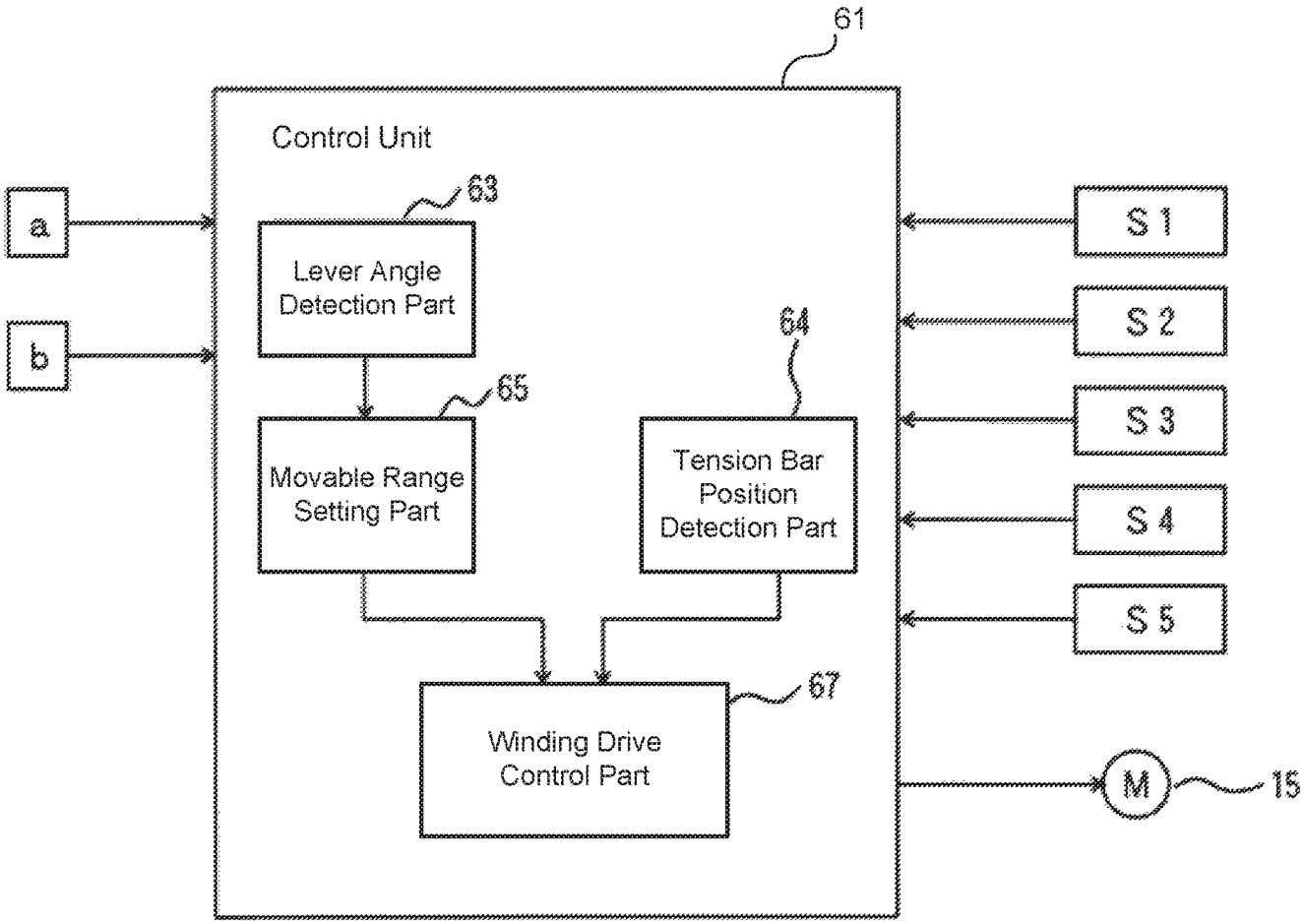
FIG. 3 is a control block diagram of the rolled sheet winding device according to the first embodiment of the present invention.

The lever angle detection sensors a and b are each, for example, made of an optical sensor, and each includes, sandwiching the lever angle detection slit plate 52, a light emitting part arranged on one side and a light receiving part arranged on the other side. The sensor outputs, i.e., ON/OFF, of the lever angle detection sensors a and b are sent to the later explained control unit 61 (FIG. 3).

When the lever angle detection slit plate 52 is rotated and the slit m1 to m3 is placed between the light emitting part and the light receiving part, the light emitted from the light emitting part is received by the light receiving part, so that the lever angle detection sensor a or b is turned ON. When a portion of the lever angle detection slit plate 52 in which the slits m1 to m3 are not formed is placed between the light emitting part and the light receiving part, the light emitted from the light emitting part is blocked by the lever angle detection slit plate 52 and cannot be received by the light receiving part, so that the lever angle detection sensors a and b are turned OFF.

Therefore, the control unit 61 reads the sensor outputs of the lever angle detection sensors a and b to detect the angle between the vertical direction and the roll diameter detection lever 51, that is, the lever angle $\alpha$, based on the sensor output to thereby detect the roll diameter.

Next, the control device of the rolled sheet winding device 11 will be described.

FIG. 3 is a control block diagram of the rolled sheet winding device according to the first embodiment of the present invention.

In this figure, the reference numeral "61" denotes a control unit, "a" and "b" denote lever angle detection sensors, and "Si (i=1 to 5)" is a bar detection sensor. The control unit 61 includes a lever angle detection part 63 as a roll diameter obtaining part for obtaining the roll diameter of the continuous paper P wound on the winding roller 14 (FIG. 1), a tension bar position detection part 64, a movable range setting part 65, and a winding drive control part 67.

As the continuous paper P is wound on the winding roller 14, in accordance with the increase in the roll diameter, the position of the carrying path between the winding part 13 and the friction member 16 changes. In accordance with that, the position of the tip end of the roll diameter detection lever 51 changes, so that the lever angle $\alpha$ increases.

So, in this embodiment, based on the sensor outputs of the lever angle detection sensors a and b, it is configured to detect the lever angle $\alpha$ of the roll diameter detection lever 51 as a roll diameter.

That is, in this embodiment, the lever angle detection part 63 detects the lever angle $\alpha$ of the roll diameter detection lever 51 at four levels based on the combination of the sensor outputs of the lever angle detection sensors a and b, so that the roll diameter is detected.

Figures 4, 5:
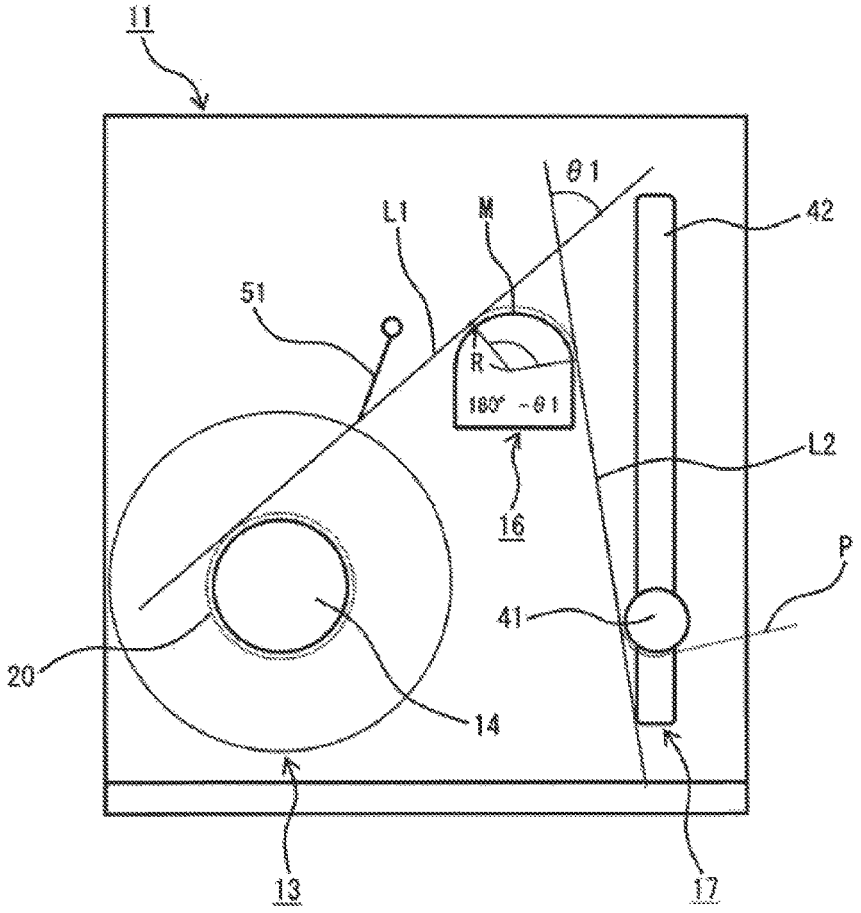
FIG. 4 shows a relationship between sensor outputs of lever angle detection sensors, lever angles, and roll diameters according to the first embodiment of the present invention.
FIG. 5 shows a contact area between a friction member and a continuous paper when the roll diameter is small according to the first embodiment of the present invention.

FIG. 4 shows the relationship between the sensor outputs of the lever angle detection sensors, the lever angles, and the roll diameters according to the first embodiment of the present invention.

As shown in this figure, the lever angle detection part 63 detects a lever angle $\alpha 1$ when the sensor output of the lever angle detection sensor a and that of the lever angle detection sensor b are ON and OFF, respectively, detects a lever angle $\alpha 2$ ($>\alpha 1$) when the sensor outputs are both OFF, detects a lever angle $\alpha 3$ ($>\alpha 2$) when the sensor outputs of the lever angle detection sensors a and b are both ON, and detects a lever angle $\alpha 4$ ($>\alpha 3$) when the sensor output of the lever angle detection sensor a and that of the lever angle detection sensor b are OFF and ON, respectively. That is, the roll diameter detected by the lever angle detection part 63 is smaller when the lever angle $\alpha$ is smaller, and is larger when the lever angle $\alpha$ is larger.

As described above, when the roll diameter changes in accordance with the winding of the continuous paper P on the winding roller 14, the position of the carrying path of the continuous paper P between the winding part 13 and the friction member 16 changes. With this, since the contact area between the friction member 16 and the continuous paper P changes, the frictional force generated between the friction member 16 and the continuous paper P and the tension applied to the continuous paper P change. As a result, the winding hardness of the rolled sheet 20 changes, which prevents stable winding of the continuous paper P.

Next, the contact area between the friction member 16 and the continuous paper P that changes according to the roll diameter will be described.

Figure 6:
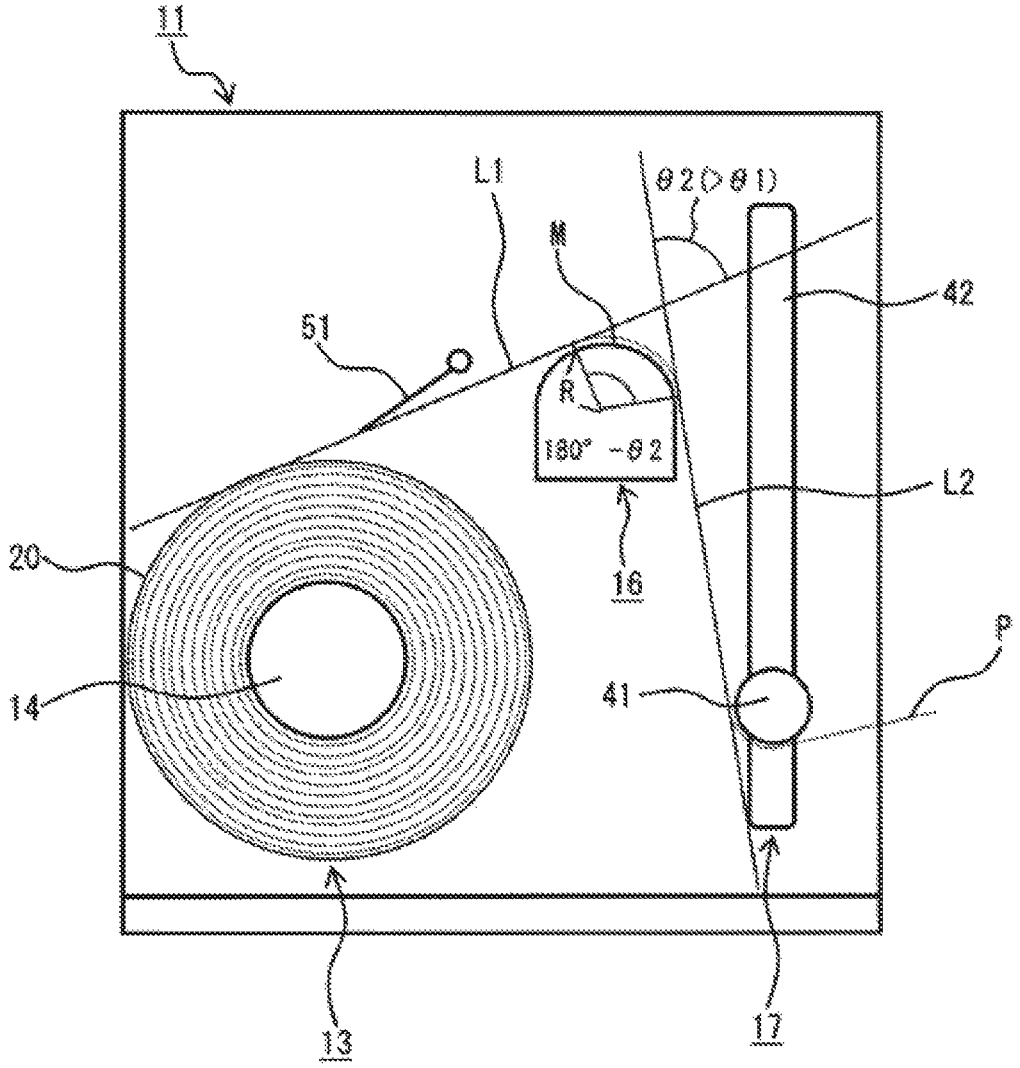
FIG. 6 shows a contact area between the friction member and the continuous paper when the roll diameter is large according to the first embodiment of the present invention.

FIG. 5 shows the contact area between the friction member and the continuous paper when the roll diameter is small according to the first embodiment of the present invention. FIG. 6 shows the contact area between the recording medium and the continuous paper when the roll diameter is large according to the first embodiment of the present invention. FIG. 7 is an explanatory view showing the relationship between the lever angle, the movable range of the tension bar, and activation/deactivation of the winding motor according to the first embodiment of the present invention.

In FIG. 5 and FIG. 6, the reference numeral "11" denotes the rolled sheet winding device, "13" denotes the winding part, "14" denotes the winding roller, "16" denotes the friction member, "17" denotes the tension bar part, "20" denotes the rolled sheet, "41" denotes the tension bar, and "51" denotes the roll diameter detection lever.

The common tangential line of the rolled sheet 20 and the sliding face M of the friction member 16 is defined as L1, and the common tangential line of the tension bar 41 and the sliding face M of the friction member 16 is defined as L2. The slope of the tangential line L1 becomes larger as the roll diameter becomes smaller, and becomes smaller as the roll diameter becomes larger. The slope of the tangential line L2 becomes larger as the tension bar 41 is lowered in the guide 42, and becomes smaller as the tension bar 41 is raised in the guide 42.

When the tension bar 41 is arranged at the same position in the guide 42, for example, at the vicinity of the lower end of the guide 42, the angle between the tangential lines L1 and L2 is defined as θ1 [degrees] when the roll diameter is small as shown in FIG. 5, and the angle between the tangential lines L1 and L2 is defined as θ2 [degrees] when the roll diameter is large as shown in FIG. 6. In this case, the relationship of the angles θ1 [degrees] and θ2 [degrees] is θ2 [degrees]>θ1 [degrees]. When the angle between the tangential lines L1 and L2 is θ1 [degrees], the friction member 16 and the continuous paper P are in contact with each other in the range of the angle of (180 [degrees]−θ1 [degrees]) in the circumferential direction of the sliding face M. When the angle between the tangential lines L1 and L2 is θ2 [degrees], the friction member 16 and the continuous paper P are in contact with each other in the range of the angle of (180 [degrees]−θ2 [degrees]) in the circumferential direction of the sliding face M. Therefore, when the contact area between the friction member 16 and the continuous paper P in the case where the roll diameter is small is defined as A1, and when the contact area between the friction member 16 and the continuous paper P in the case where the roll diameter is large is defined as A2, the relationship of the contact areas A1 and A2 is A1>A2.

Further, when the radius of the upper half part of the friction member 16 is R, the friction coefficient of the sliding face M is μ, the frictional force generated between the friction member 16 and the continuous paper P when the roll diameter is small is F1, and the frictional force generated between the friction member 16 and the continuous paper P when the roll diameter is large is F2, the frictional forces F1 and F2 are:

$$F1=C\mu R(180\ [\text{degrees}]-\theta 1)$$

$$F2=C\mu R(180\ [\text{degrees}]-\theta 2),\ \text{and}$$

$$F1>F2,$$

where C is a coefficient.

That is, when the roll diameter is smaller, the frictional force generated between the friction member 16 and the continuous paper P is larger, increasing the tension applied to the continuous paper P between the winding part 13 and the friction member 16, which results in a larger winding hardness. When the roll diameter becomes larger, the frictional force generated between the friction member 16 and the continuous paper P becomes smaller, reducing the tension applied to the continuous paper P between the winding part 13 and the friction member 16, which results in a smaller winding hardness.

Therefore, in this embodiment, the tension bar 41 is moved depending on the roll diameter to change the contact area between the friction member 16 and the continuous paper P. That is, by changing the position of the tension bar 41 depending on the roll diameter to make the contact area between the friction member 16 and the continuous paper P constant, the tension applied to the continuous paper P can be made constant, resulting in an even winding hardness.

For this reason, the movable range setting part 65 (FIG. 3) reads the lever angle α detected by the lever angle detection part 63 and sets the movable range of the tension bar 41 depending on the lever angle α, and the winding drive control part 67 activates or deactivates the winding motor 15 depending on the movable range of the tension bar 41.

That is, as shown in FIG. 7, the movable range setting part 65 sets the movable range of the tension bar 41 as follows. When the lever angle α1 is detected, the movable range setting part 65 sets the movable range of the tension bar 41 to the uppermost area AR1 of the guide 42. When the lever angle α2 is detected, the movable range setting part 65 sets the movable range of the tension bar 41 to an area AR2 below the area AR1. When the lever angle α3 is detected, the movable range setting part 65 sets the movable range of the tension bar 41 to an area AR3 below the area AR2. When the lever angle α4 is detected, the movable range setting part 65 sets the movable range of the tension bar 41 to an area AR4 below the area AR3.

The area AR1 is set so that the bar detection sensors S1 and S2 are shielded by the shielding plate 44 (FIG. 1) and the sensor outputs of the bar detection sensors S1 and S2 are both OFF. The tension bar 41 is moved downward and the center of the tension bar 41 reaches the lower limit position of the area AR1, making the bar detection sensor S1 unshielded by the shielding plate 44, which makes the sensor output of the bar detection sensor S1 and that of the bar detection sensor S2 ON and OFF, respectively. As a result, the winding drive control part 67 activates the winding motor 15 to rotate the winding roller 14. The tension bar 41 is moved upward and the center of the tension bar 41 reaches the upper limit position of the area AR1, making both the bar detection sensors S1 and S2 unshielded by the shielding plate 44, which makes both the sensor outputs of the bar detection sensors S1 and S2 ON. At this time, the winding drive control part 67 deactivates the winding motor 15 to stop the rotation of the winding roller 14.

Further, the area AR2 is set so that the bar detection sensors S2 and S3 are shielded by the shielding plate 44 and both the sensor outputs of the bar detection sensors S2 and S3 are OFF. Next, the tension bar 41 is moved downward and the center of the tension bar 41 reaches the lower limit position of the area AR2, making the bar detection sensor S2 unshielded by the shielding plate 44, which makes the sensor output of the bar detection sensor S2 and that of the bar detection sensor S3 ON and OFF, respectively. At this time, the winding drive control part 67 activates the winding motor 15 to rotate the winding roller 14. Further, the tension bar 41 is moved upward and the center of the tension bar 41 reaches the upper limit position of the area AR2, making the bar detection sensors S2 and S3 unshielded by the shielding plate 44, which makes both the sensor outputs of the bar detection sensors S2 and S3 ON. At this time, the winding drive control part 67 deactivates the winding motor 15 to stop the rotation of the winding roller 14.

Further, the area AR3 is set so that the bar detection sensors S3 and S4 are shielded by the shielding plate 44 and both the sensor outputs of the bar detection sensors S3 and S4 are OFF. Next, the tension bar 41 is moved downward and the center of the tension bar 41 reaches the lower limit position of the area AR3, making the bar detection sensor S3 unshielded by the shielding plate 44, which makes the sensor output of the bar detection sensor S3 and that of the bar detection sensor S4 ON and OFF, respectively. At this time, the winding drive control part 67 activates the winding motor 15 to rotate the winding roller 14. Further, the tension bar 41 is moved upward and the center of the tension bar 41 reaches the upper limit position of the area AR3, making the bar detection sensors S3 and S4 unshielded by the shielding plate 44, which makes both the sensor outputs of the bar detection sensors S3 and S4 ON. At this time, the winding drive control part 67 deactivates the winding motor 15 to stop the rotation of the winding roller 14.

Further, the area AR4 is set so that the bar detection sensors S4 and S5 are shielded by the shielding plate 44 and both the sensor outputs of the bar detection sensors S4 and S5 are OFF. Next, the tension bar 41 is moved downward and the center of the tension bar 41 reaches the lower limit position of the area AR4, making the bar detection sensor S4 unshielded by the shielding plate 44, which makes the sensor output of the bar detection sensor S4 and that of the bar detection sensor S5 ON and OFF, respectively. At this time, the winding drive control part 67 activates the winding motor 15 to rotate the winding roller 14. Further, the tension bar 41 is moved upward and the center of the tension bar 41 reaches the upper limit position of the area AR4, making the bar detection sensors S4 and S5 unshielded by the shielding plate 44, which makes both the sensor outputs of the bar detection sensors S4 and S5 ON. At this time, the winding drive control part 67 deactivates the winding motor 15 to stop the rotation of the winding roller 14.

Next, examples of the movable range of the tension bar 41 when the roll diameter is small and when the roll diameter is large will be described.

Figure 8:
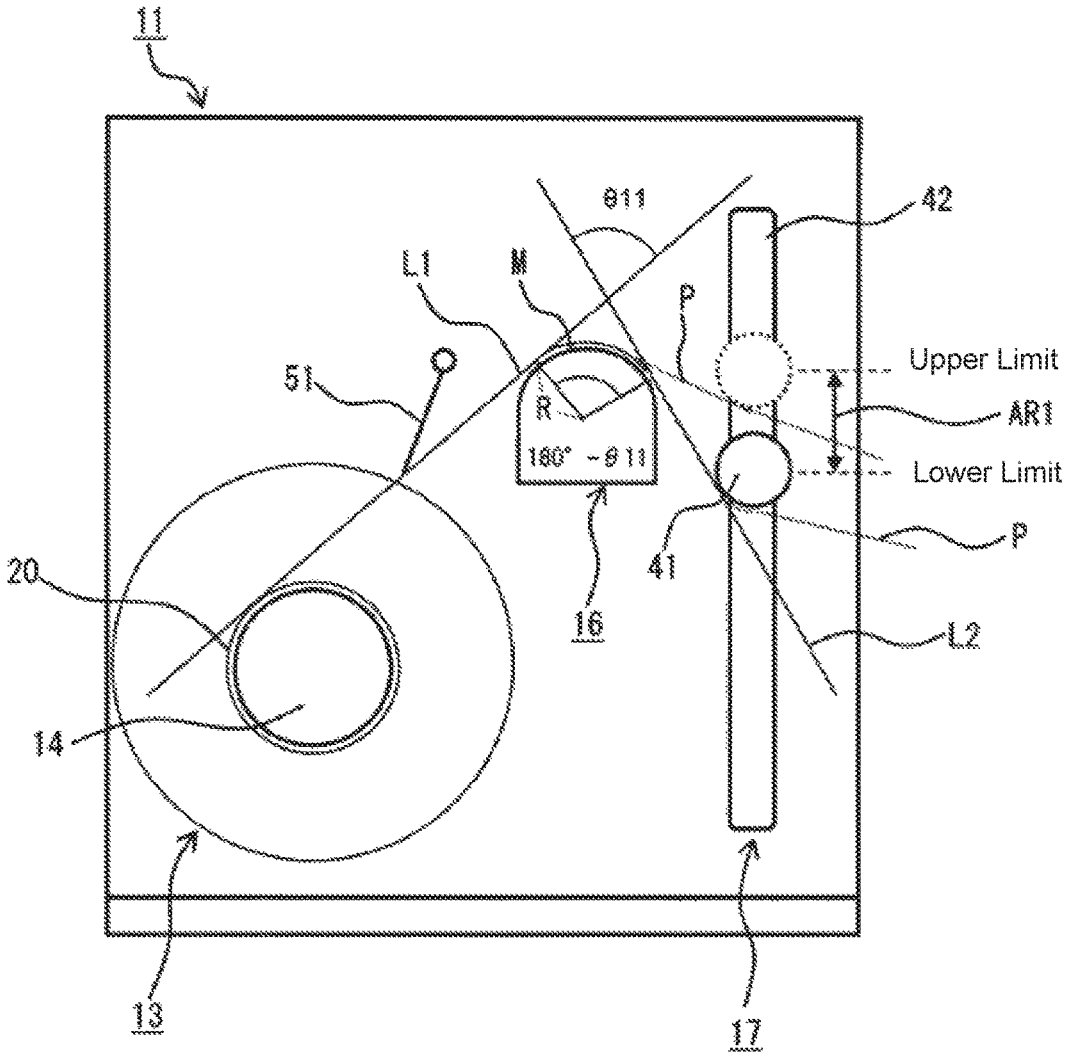
FIG. 8 illustrates an example of the movable range of the tension bar when the roll diameter is small according to the first embodiment of the present invention.
Figure 9:
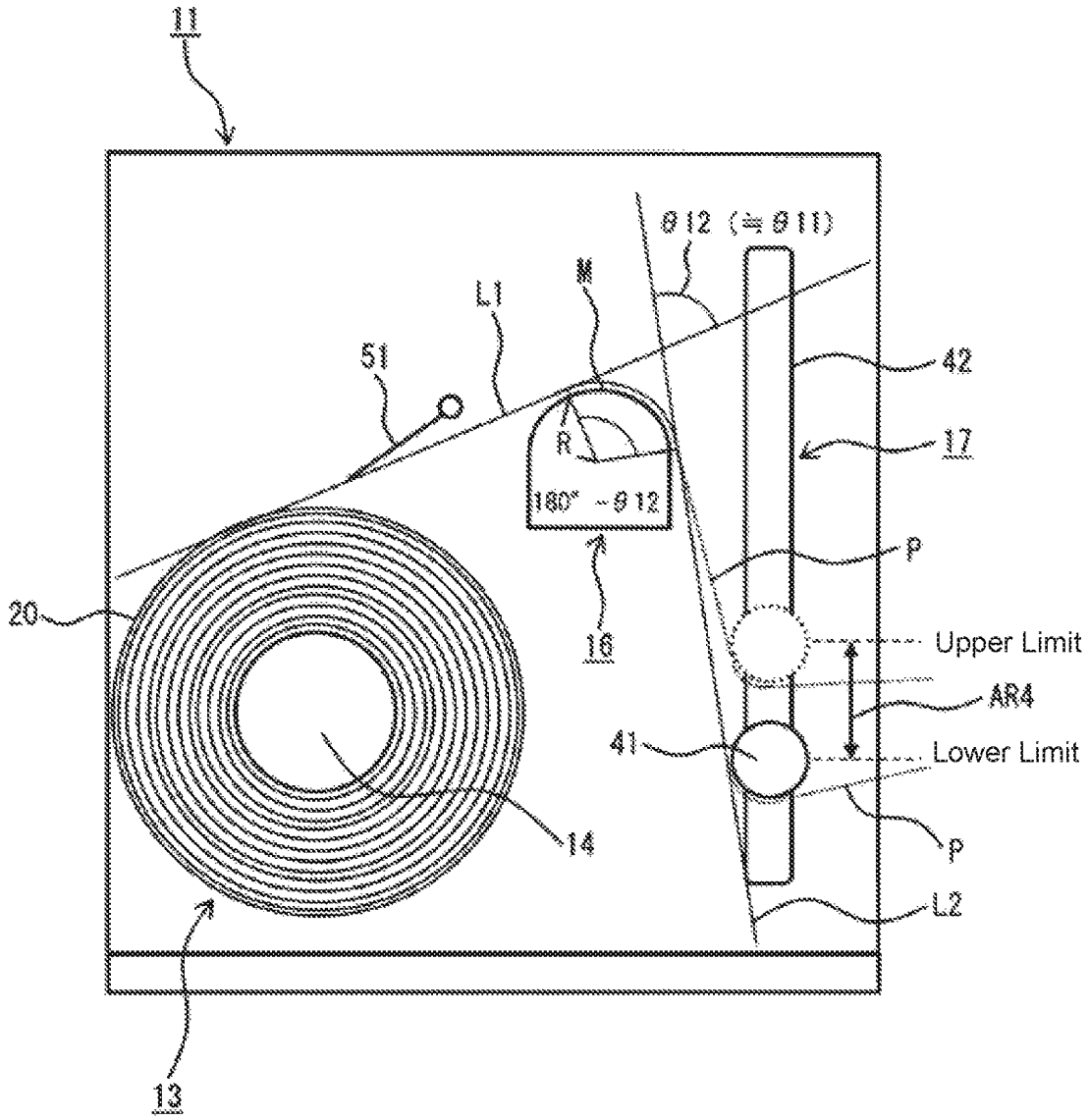
FIG. 9 illustrates an example of the movable range of a tension bar when the roll diameter is large according to the first embodiment of the present invention.

FIG. 8 shows an example of the movable range of the tension bar when the roll diameter is small according to the first embodiment of the present invention, and FIG. 9 shows an example of the movable range of the tension bar when the roll diameter is large according to the first embodiment of the present invention.

In these figures, the reference numeral "11" denotes the rolled sheet winding device, "13" denotes the winding part, "14" denotes the winding roller, "16" denotes the friction member, "17" denotes the tension bar part, "20" denotes the rolled sheet, "41" denotes the tension bar, and "51" denotes the roll diameter detection lever.

As shown in FIG. 8, when the roll diameter is small, the movable range of the tension bar 41 is set to the area AR1 near the upper end of the guide 42. When the center of the tension bar 41 reaches the lower limit position, the winding motor 15 (FIG. 1) is activated to rotate the winding roller 14. When the center of the tension bar 41 reaches the upper limit position, the winding motor 15 is deactivated to stop the rotation of the winding roller 14.

In accordance with the changes of the position of the tension bar 41, the slope of the tangential line L2 changes, but the center of the tension bar 41 will not take a position below the lower limit position of the area AR1.

Therefore, the slope of the tangential line L2 will not become larger than the slope when the center of the tension bar 41 is placed at the lower limit position of the area AR1, and the angle between the tangential lines L1 and L2 will not become smaller than the value θ11 [degrees] when the center of the tension bar 41 is placed at the lower limit position of the area AR1. Further, the friction member 16 and the continuous paper P will not come into contact with each other in a range of an angle larger than (180 [degrees]−θ11 [degrees]) in the circumferential direction of the sliding face M.

On the other hand, as shown in FIG. 9, when the roll diameter is large, the movable range of the tension bar 41 is set to the area AR4 near the lower end of the guide 42. When the center of the tension bar 41 reaches the lower limit position, the winding motor 15 (FIG. 1) is activated to rotate the winding roller 14. When the center of the tension bar 41 reaches the upper limit position, the winding motor 15 is deactivated to stop the rotation of the winding roller 14.

In accordance with the changes of the position of the tension bar 41, the slope of the tangential line L2 changes, but the center of the tension bar 41 will not take a position above the upper limit position of the area AR4.

Therefore, the slope of the tangential line L2 will not become larger than the slope when the center of the tension bar 41 is placed at the upper limit position of the area AR4, and the angle between the tangential lines L1 and L2 will not become smaller than the value θ12 [degrees] when the center of the tension bar 41 is arranged at the upper limit position of the area AR4.

Further, the friction member 16 and the continuous paper P will not come into contact with each other in a range of an angle smaller than (180 [degrees]−θ12 [degrees]) in the circumferential direction of the sliding face M.

As a result, the angle between the tangential lines L1 and L2 can be maintained in a constant range in which:

$$\theta 11\ [\text{degrees}] \approx \theta 12\ [\text{degrees}], \text{ and}$$

$$(180\ [\text{degrees}] - \theta 11\ [\text{degrees}]) \approx (180\ [\text{degrees}] - \theta 12\ [\text{degrees}]).$$

With this, even when the roll diameter of the rolled sheet 20 changes, since the contact area between the friction member 16 and the continuous paper P can be made constant, the frictional force generated between the friction member 16 and the continuous paper P and the tension applied to the continuous paper P can be made constant.

In this way, in this embodiment, since the roll diameter of the rolled sheet 20 wound on the winding roller 14 is obtained and the tension generated on the continuous paper P by the friction member 16 is adjusted depending on the obtained roll diameter, the winding hardness of the rolled sheet 20 can be made constant from the beginning to the end of winding. As a result, the continuous paper P can be wound stably.

In the first embodiment, the position of the tension bar 41 is detected by the bar detection sensor S1 (i=1 to 5) at a plurality of positions of the guide 42 and the lever angle α of the roll diameter detection lever 51 is detected at four levels by the lever angle detection sensors a and b. Therefore, the winding hardness of the rolled sheet 20 may be slightly varied.

A second embodiment of the present invention will be described, in which the position of the tension bar 41 and the lever angle α of the roll diameter detection lever 51 are detected continuously to prevent the winding hardness of the rolled sheet 200 from being varied. In the following description, the same symbols will be allotted to the structures that are the same as the first embodiment. As to the effects of the invention for having the same structure, the effects of the first embodiment will be incorporated herein.

Figure 10:
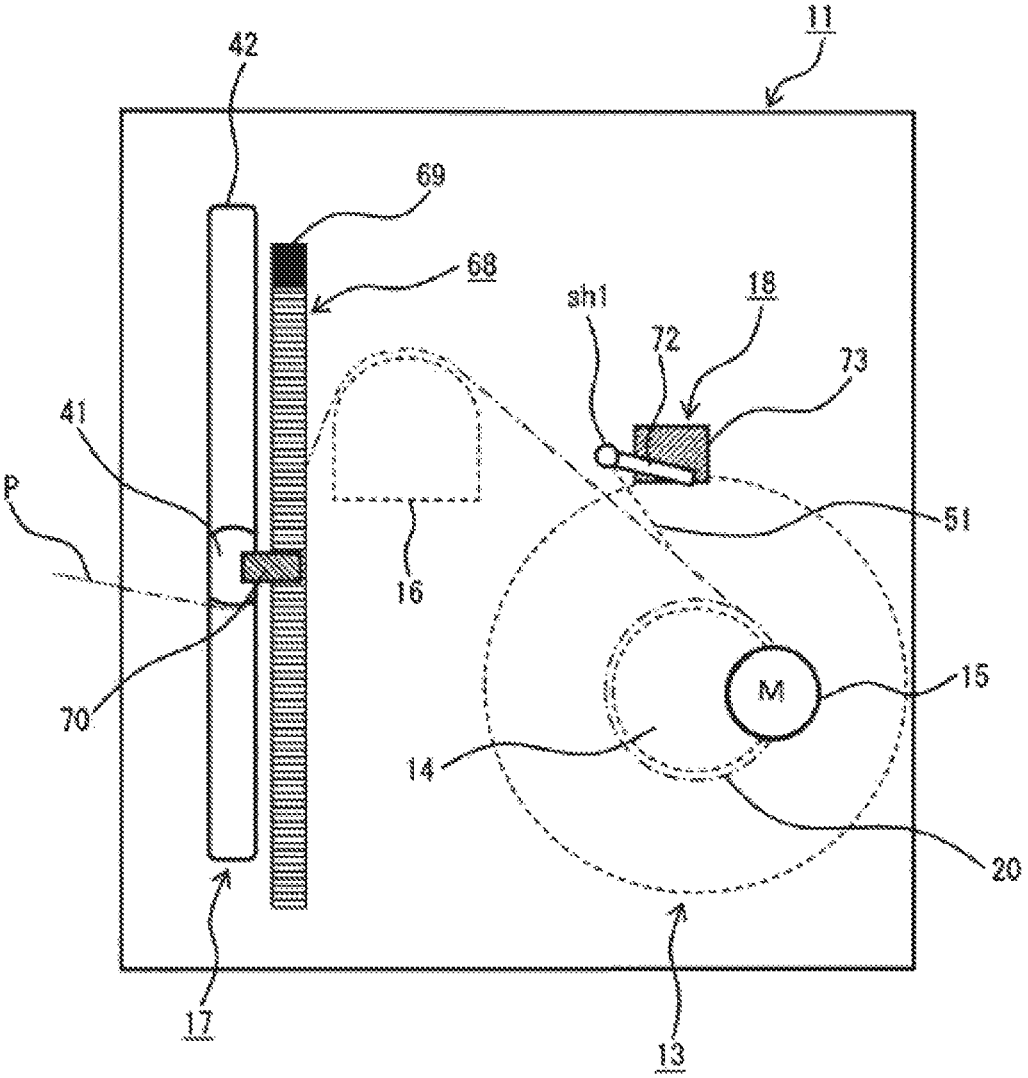
FIG. 10 is a schematic view of a rolled sheet winding device according to a second embodiment of the present invention.

FIG. 10 is a schematic view of a rolled sheet winding device according to the second embodiment of the present invention.

In this figure, the reference numeral "17" denotes a tension bar part as a tension adjustment unit. The tension bar part 17 includes: for example, a tension bar 41 as a tension applying member arranged extending in the widthwise direction of the continuous paper P as a medium and movably in the height direction of the rolled sheet winding device 11; a guide 42 as a guiding member for guiding the tension bar 41 and arranged extending in the height direction of the rolled sheet winding device 11; a linear scale 68 as a detection part arranged extending in the height direction of the guide 42; a reference position mark 69 showing the reference position of the tension bar 41 and arranged at a predetermined position, at an upper end in this embodiment, of the linear scale 68; and a bar detection sensor 70 as a detection element for continuously (linearly) detecting the position of the tension bar 41, fixed at one end of the tension bar 41 and moved in accordance with the movement of the tension bar 41.

In this embodiment, a predetermined striped pattern is formed on the linear scale 68 and a two-phase output type sensor is used as the bar detection sensor 70. When the tension bar 41 is moved along the guide 42, the bar detection sensor 70 generates a sensor output consisting of ON/OFF signals different in phase depending on the striped pattern of the linear scale 68 at a position at which the tension bar 41 is arranged, and sends it to the control unit 61 (FIG. 3).

Further, at the reference position mark 69, a striped pattern that is different from the linear scale is formed.

Further, the reference numeral "18" denotes a roll diameter detection mechanism. The roll diameter detection mechanism 18 includes: for example, a roll diameter detection lever 51 as a detection member and a detection lever that is swingably arranged with the supporting shaft sh1 as the swinging center; a lever angle detection plate 72 as an interlocking member rotated interlocking with the swinging of the roll diameter detection lever 51; and a lever angle detection sensor 73 as a lever angle detection element and an interlocking member detection part for continuously detecting the lever angle α of the roll diameter detection lever 51 as a roll diameter by detecting the displacement of the lever angle detection plate 72.

The lever angle detection sensor 73 generates a sensor output of an analog signal and sends it to the control unit 61.

The control unit 61 reads each of sensor outputs of the winding drive control part 67 and the lever angle detection sensor 73, and sets the movable range of the tension bar 41 to an area depending on the lever angle α of the roll diameter detection lever 51.

In this way, in this embodiment, in accordance with the movement of the tension bar 41, the bar detection sensor 70 is moved along the linear scale 68 and generates the sensor output. This enables the control unit 61 to continuously detect the position of the tension bar 41.

As a result, the lever angle α of the roll diameter detection lever 51 can be detected steplessly, which can assuredly prevent occurrence of variations in the winding hardness of the rolled sheet 20.

In the first and second embodiments, the lever angle α of the roll diameter detection lever 51 is detected as a roll diameter, but the roll diameter can be calculated.

That is, when the rotation speed of the winding motor 15 as a winding actuator is N [rps] and the roll diameter of the rolled sheet 20 as a rolled medium is r [mm], the winding speed vr [mm/s] of the continuous paper P is represented by $$vr\ [\text{mm/s}]=2\pi\cdot r\ [\text{mm}]\cdot N\ [\text{l/s}].$$

Also, the difference of the length of the paths between the carrying path of the continuous paper P when the center of the tension bar 41 is arranged at the upper limit position of the movable range and the carrying path of the continuous paper P when the center of the tension bar 41 is arranged at the lower limit position of the movable range, that is, the route difference, is d [mm], and the time it takes for the tension bar 41 to move from the lower limit position to the upper limit position of the movable range is t [s]. The time t [s] can be shown by the following Equation (1) based on the speed difference δv [mm/s] between the winding speed vr [mm/s] and the ejection speed vd [mm/s] when the continuous paper P is ejected from the printer 10 as an image forming device, δv=vr−vd, and the route difference d [mm].

(Eg. 1)

$$t[s] = \frac{d\ [\text{mm}]}{(vr - vd)\ [\text{mm/s}]} = \frac{d\ [\text{mm}]}{(2\pi Nr - vd)\ [\text{mm/s}]} \quad (1)$$

Therefore, the control unit 61 as a roll diameter obtaining unit can obtain the roll diameter [mm] from Equation (1) by calculation. The time t [s] is timed by an unillustrated timer arranged in the control unit 61.

In this case, since the roll diameter can be calculated by the control unit 61, there is no need to arrange a roll diameter detection mechanism 18 such as in the first and the second embodiments. Therefore, the structure of the rolled sheet winding device 11 can be simplified.

In each of the embodiments, the rolled sheet winding device 11 arranged adjacent to the printer 10 was described, but the present invention can be applied to a medium winding device arranged adjacent to an image forming device, such as, e.g., a photocopier, a facsimile apparatus, and a multifunction device.

It should be noted that the present invention is not limited to each of the aforementioned embodiments, and can be modified in various ways based on the gist of the present invention. These modifications are not excluded from the scope of the present invention.

What is claimed is:

1. A medium winding device for winding a continuous medium ejected from an image forming device, comprising:

a winding member that is rotatably arranged around which the medium is wound;

an actuator that rotates the winding member to wind the medium on the winding member in a rolled state;

a tension generation member that has a sliding face (M) that is a round peripheral;

a tension adjustment unit that moves forward and backward with respect to the medium, wherein the tension adjustment unit, the tension generation member and the winding member are arranged in these order from the image forming device along a carrying path, the carrying path being formed by the tension adjustment unit, the tension generation member and the winding member guiding the medium that runs in a carrying direction toward the winding member wherein the carrying path curves at the tension adjustment unit and at the tension generation member, the sliding face (M) of the tension generation member is steady with respect to the medium winding device and pressed against the medium running in the carrying direction such that a friction force is generated by the medium rubbing on the sliding face at a contact area within which the medium contacts to the sliding face, the friction force being oriented in an opposite direction to the carrying direction and applying a tension to the medium so that the tension works to pull the medium tight between the tension generation member and the winding member, the tension adjustment unit is pressed to the medium such that the medium is pulled tight between the tension adjustment unit and the tension generation member, the contact are of the sliding face is defined by two points on the sliding face that are a downstream point and an upstream point wherein the downstream point has an tangential line (L1) that coincides to the carrying path between the tension generation member and the winding member, and the upstream point has another tangential line (L2) that coincides to the carrying path between the tension adjustment unit and the tension generation, the medium winding device further comprises a roll diameter obtaining unit that is positioned between the tension generation member and the winding member, and obtains a roll diameter of the medium in the rolled state, wherein the roll diameter changes depending on an amount of the medium wound on the winding member, the tension adjustment unit moves to adjust a position of the upstream point of the contact area depending on the roll diameter obtained by the roll diameter obtaining unit.

2. The medium winding device according to claim 1, wherein the tension adjustment unit includes a guide and a tension bar around which the carrying path curves, the tension bar is moved along the guide in correspondence with the roll diameter obtained by the roll diameter so as to change the upstream point of the contact area.

3. The medium winding device according to claim 2, further comprising:

a movable range setting part that sets movable ranges of the tension bar, the guide being segmented by two or more sections in a longitudinal direction, and each of the movable ranges being assigned to one of the sections, and a winding drive control part that controls the actuator, wherein when the tension bar is set to one of the movable ranges, which is defined as an assigned range, the winding drive control part allows the tension bar to reciprocate within the assigned range.

4. The medium winding device according to claim 3, wherein the tension adjustment unit further includes a detection element that detects a position of the tension bar and generates a sensor output corresponding to the position of the tension bar, and the winding drive control part controls the actuator in the basis of the sensor output of the detection element.

5. The medium winding device according to claim 1, wherein the roll diameter obtaining unit includes a roll diameter detection mechanism to detect the roll diameter.

6. The medium winding device according to claim 5, wherein the roll diameter detection mechanism includes a detection lever that is swingably arranged in a manner such that a tip end of the detection lever is in contact with the medium, the detection lever being rotated corresponding to the roll diameter, and a lever angle detection element that generates a sensor output corresponding to a lever angle of the detection lever, and the roll diameter obtaining unit obtains the roll diameter in the basis of the sensor output of the lever angle detection element.

7. The medium winding device according to claim 1, wherein the tension adjustment unit includes a tension bar that is movably arranged to change the upstream point of the contact area in accordance with a movement of the tension bar, and the roll diameter obtaining unit calculates the roll diameter in the basis of a speed difference between a winding speed of the medium and an ejection speed of the medium when the medium is ejected from the image forming device, a route difference of the carrying path of the medium when the tension bar is moved, and a time that the tension bar is required to move.

8. The medium winding device according to claim 1, wherein the roll diameter obtaining unit detects an inclined degree of the carrying path at the downstream point extending to the winding member, and calculates the roll diameter using the inclined degree.

9. A method for winding a medium that includes a medium winding device including a winding member rotatably arranged, an actuator rotating the winding member to wind a medium ejected from an image forming device on the winding member in a rolled state, and a tension generation member applying a tension to the medium that is being carried to the winding member, wherein the tension generation member that has a sliding face (M) that is a round peripheral, the sliding face (M) being steady with respect to the medium winding device and pressed against the medium running toward the winding member such that a friction force is generated by the medium rubbing on the sliding face at a contact area within which the medium contacts to the sliding face, the friction force being oriented in an opposite direction to the carrying direction and applying a tension to the medium so that the tension works to pull the medium tight between the tension generation member and the winding member, and the contact area of the sliding face is defined by two points on the sliding face that are a downstream point and an upstream point wherein the downstream point has an tangential line (L1) that coincides to the carrying path at a downstream side and the upstream point has another tangential line (L2) that coincides to the carrying path at an upstream side, the method comprising:

obtaining a roll diameter of the medium in the rolled state around the winding member, wherein the roll diameter changes depending on an amount of the medium; and adjusting the upstream point of the contact area depending on the obtained roll diameter.

* * * * *